US005606787A

United States Patent [19]

McGuire

[11] Patent Number: 5,606,787

[45] Date of Patent: Mar. 4, 1997

[54] CONTINUOUS METHOD FOR PRODUCING FINAL GAUGE STAINLESS STEEL PRODUCT

[75] Inventor: Michael F. McGuire, Pittsburgh, Pa.

[73] Assignee: J & L Specialty Steel, Inc., Pittsburgh, Pa.

[21] Appl. No.: 527,881

[22] Filed: Sep. 14, 1995

Related U.S. Application Data

[63] Continuation of Ser. No. 180,094, Jan. 11, 1994, abandoned.

[51] Int. Cl.[6] ..... B22D 11/128; B21C 43/04; B23P 25/00

[52] U.S. Cl. ..... 29/81.03; 29/33 C; 29/33 Q; 29/33 S; 29/527.4; 134/15; 148/610

[58] Field of Search ..... 29/33 C, 33 Q, 29/33 S, 81.03, 81.04, 527.4–527.7; 72/40, 200–202, 366.2; 134/2, 15; 164/417, 476, 477; 148/318, 610; 204/145 R

[56] References Cited

U.S. PATENT DOCUMENTS

| | | | |
|---|---|---|---|
| Re. 28,494 | 7/1975 | Rowe | 148/12 EA |
| 3,141,800 | 7/1964 | Reichenbach | 148/12.3 |
| 3,784,418 | 1/1974 | Randak et al. | 148/12 |
| 3,873,280 | 3/1975 | Block et al. | 134/2 X |
| 4,046,601 | 9/1977 | Hook | 148/318 X |
| 4,373,971 | 2/1983 | Sawatani et al. | 148/12 EA |
| 4,374,683 | 2/1983 | Koike et al. | 148/12 EA |
| 4,394,188 | 7/1983 | Harase et al. | 148/12 EA |
| 4,448,614 | 5/1984 | Morimoto et al. | 134/15 X |
| 4,550,487 | 11/1985 | Hoshino et al. | 29/527.7 |
| 4,824,536 | 4/1989 | Kim et al. | 204/145 R |
| 4,872,245 | 10/1989 | Kawasaki et al. | 29/81.03 |
| 4,878,955 | 11/1989 | Hoshino et al. | 148/12 E |
| 4,885,042 | 12/1989 | Kenmochi et al. | 148/12 E |
| 5,019,181 | 5/1991 | Yazawa et al. | 148/12 EA |
| 5,074,927 | 12/1991 | Rodrigues et al. | 148/12 EA |
| 5,092,393 | 3/1992 | Suehiro et al. | 164/476 |
| 5,181,970 | 1/1993 | Ueda et al. | 148/610 |
| 5,197,179 | 3/1993 | Sendzimir et al. | 29/527.4 |

FOREIGN PATENT DOCUMENTS

| | | | |
|---|---|---|---|
| 707635 | 1/1980 | U.S.S.R. | 29/81.03 |

*Primary Examiner*—Peter Vo

*Attorney, Agent, or Firm*—Buchanan Ingersoll, P.C.; Michael L. Dever

[57] ABSTRACT

A continuous process line for converting hot rolled stainless steel strip to final gauge product is provided. The stainless steel strip has a scale formed on the surface thereof. The steel strip is introduced to a rolling mill to reduce the thickness of the hot rolled stainless steel to a final gauge thickness and tolerance. The rolling mill also cracks the scale on the surface of the final gauge thickness strip. An annealing section anneals the final gauge thickness strip received from the rolling mill. A pickling section pickles the annealed strip from the annealing section and removes the scale from the surface. Preferably, a molten salt bath section provided between the annealing section and the pickling section conditions the scale cracked in the cold rolling section and passes the conditioned stainless steel to the pickling section.

25 Claims, 5 Drawing Sheets

CONTINUOUS METHOD FOR PRODUCING FINAL GAUGE STAINLESS STEEL PRODUCT

This application is a continuation of application Ser. No. 08/180,094, filed Jan. 11, 1994, now abandoned.

BACKGROUND OF THE INVENTION

1. Field of the Invention

The invention relates the field of treating hot rolled stainless strip and strip cast and, more particularly, to a method for converting hot rolled stainless steel strip and strip cast to a final gauge product in a continuous operation.

2. Description of the Background Art

The most widely used procedure for converting hot rolled or strip cast stainless steel (hot band) into a final gauge cold rolled product consists of converting the hot band to an annealed, shot blasted, and pickled "white band" and subsequently cold rolling that product to final gauge. Extensive cold rolling of the strip is necessary to produce a smooth surface. This extensive cold rolling is necessary because shot blasting and other surface cleaning steps are used to crack and remove the scale that forms on the surface of the stainless steel strip during hot rolling and strip casting. The cold rolling step is also necessary to bring the thickness of the hot band and strip cast strip to within cold-rolled tolerances even when the hot band or strip cast band can be produced to a gauge normally obtained by cold rolling.

U.S. Pat. No. 5,197,179 is representative of the typical procedure for forming a final gauge product from hot band. Therein, the hot band is converted to a cold rolled product by cold rolling, annealing and pickling. However, the cold rolled product formed by that process has a shot-blasted finish and thus is in a condition requiring subsequent processing to final gauge. It is not itself in a final gauge condition. Rather, the cold rolled product must still be subsequently rolled to final gauge.

The extensive cold rolling required by the prior processes limits the ability of the hot band to be converted into a final gauge product in a single, continuous operation. This adds both time and cost to the final gauge production. Accordingly, there is a need for a continuous process for converting hot band and strip cast into final gauge product which does not require extensive cold rolling of the stainless steel.

SUMMARY OF THE INVENTION

A method for converting hot rolled stainless steel strip to a final gauge product has been provided in which shot blasting may not be needed to remove the scale. In the present method, the strip is cold rolled to reduce the thickness of the steel to a final gauge thickness. This cold rolling of the steel cracks the scale on the surface of the strip. The steel can then be annealed and pickled as in known procedures. In the pickling step, the scale is removed from the surface of the steel. If desired, the annealed strip can be introduced to a molten salt bath to condition the scale on the surface of the strip prior to the annealed strip being pickled.

The present method can be performed in a single, continuous line or, if desired, can be performed as separate discrete stages. If performed in a continuous line, the final gauge steel product can be processed at significant time and cost efficiencies.

DETAILED DESCRIPTION OF THE INVENTION

Figure 1:
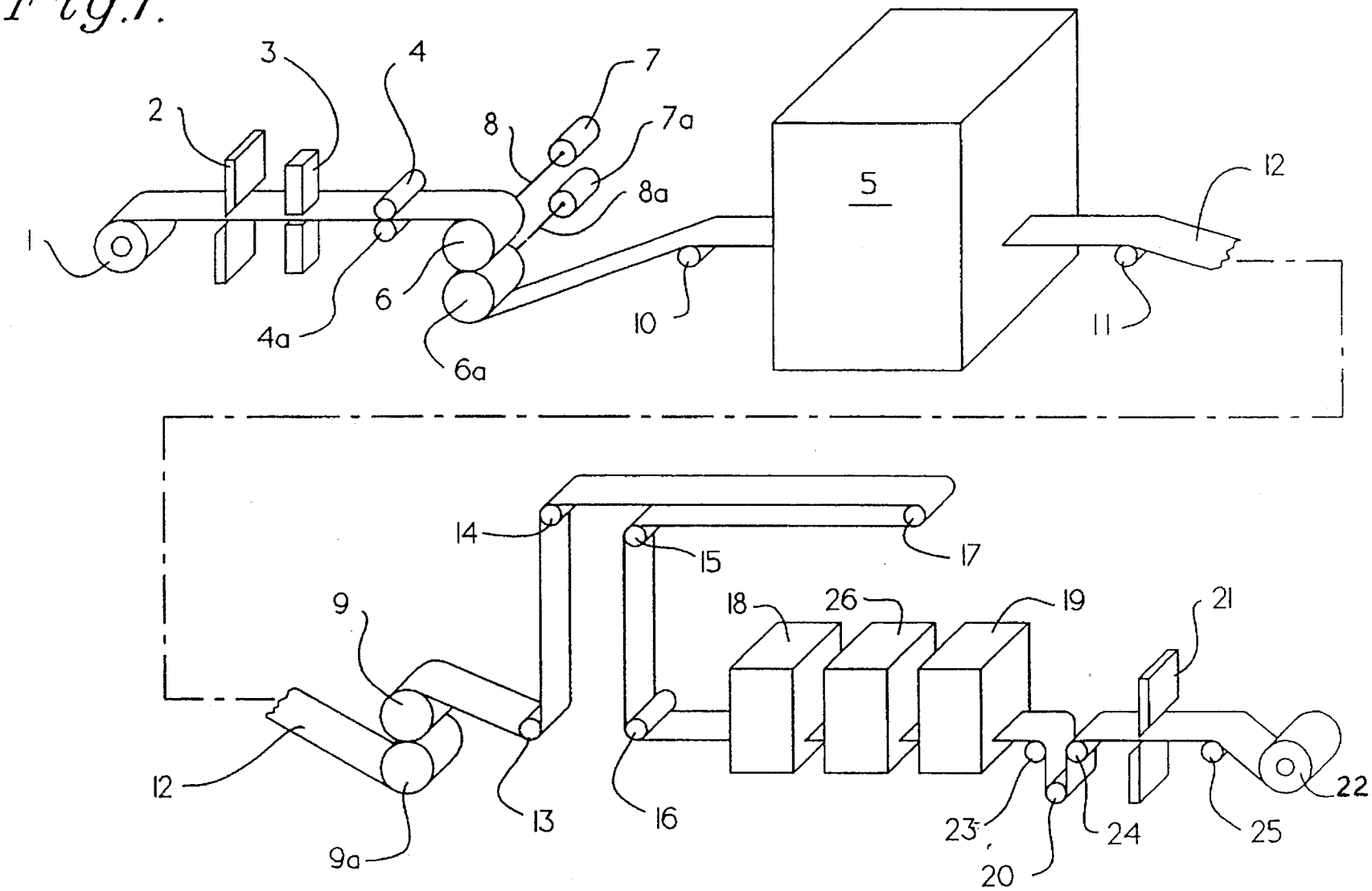
FIG. 1 is a semi-diagrammatic isometric view of the process line for reducing hot rolled stainless steel to final gauge product in accordance with the present invention.

FIG. 1 is a semi-diagrammatic representation of the process line of the present invention. It should be noted that the line is much more complex than indicated herein. For example, the furnace section generally consists of heating zones, holding and cooling zones, and a pickle section generally consists of several tanks containing pickling chemicals, together with washing and drying equipment to remove the chemicals. Moreover, the cold rolling mill includes work rolls, intermediate rolls, back-up rolls and may also include side support rolls.

The main elements of the process line include a payoff, or uncoiler 1, on which the hot rolled stainless steel coils are loaded, and from which they are uncoiled. A shear 2 cuts the coil ends to prepare them for welding. Welder 3 joins the end of successive coils to form a continuous strip. A pair of pinch rolls 4 and 4*a* position the rearward end of a coil ready for shearing to position it against the nose of the next coil to which it will be welded.

After the strip has been welded together, the continuous strip passes through cold rolling mill 5 which includes a plurality of mill stands. A tension bridle consisting of two or more bridle rolls 6 and 6*a* at the entry side of mill 5 is preferably provided. Bridle rolls 6 and 6*a* are driven (or braked) by electric motors (drag generators) 7 and 7*a* by means of spindles 8 and 8*a*. A tension bridle consisting of two or more bridle rolls 9 and 9*a* are also provided on the exit side of mill 5. Pass line rollers 10 and 11 define the travel path of the strip 12 through mill 5. Roller 13 at the exit side of bridle rolls 9 and 9*a* defines the path of strip 12 to a entry storage loop. If desired, a strip washer, not shown, may be provided between the cold rolling mill 5 and the exit bridle rolls 9 and 9*a*.

The entry storage loop consists of fixed rollers 14, 15 and 16 and-a movable roller 17 used to provide strip 12 to the annealing section 18 when the payoff is stopped to allow loading of a new coil and welding of its nose to the tail of the previous coil. Annealing section 18 consists of heating and cooling devices used to soften or anneal the strip. A pickling section 19 comprising tanks of chemicals used to removed impurities from the strip surface and washing equipment to clean the strip is provided downstream of the annealing section. An exit storage loop 20 draws material from the pickle section 19 when the exit shear 21 operates at completion of rewinding a coil at rewinder 22, and during the time the coil is removed prior to feeding the nose end of the next coil to the rewinder 22. Pass line rollers 23, 24 and 25 are used to define the path of the strip. Preferably, a molten salt bath 26 is provided intermediate the annealing section 18 and pickling section 19. Preferably, the molten salt is a kolene-type salt.

In operation, the hot rolled steel product which is introduced into rolling mill 5 has a scale formed on the surface thereof. In rolling mill 5, where the steel product is reduced to final gauge thickness, the scale on the surface of the stainless strip 12 is cracked. This cracked scale is conditioned in molten salt bath section 26 and finally removed in pickling section 19.

Preferably, black band steel is provided having a thin, uniform oxide of 2 μM or less by laminar cooling the as-rolled band from the rolling temperature to under 800° C. The black band should have a thickness in the range of 0.060 inches to 0.300 inches in thickness. During cold rolling, the thickness of the band is reduced from 10% to 80%.

Using the process of the present invention, a final gauge product can be produced which is 2 D cold rolled stainless steel having a surface roughness equal or less than 80μ in $R_a$ (1.5 μM). After temper-passing, the final product becomes 2 B having a surface roughness of less than or equal to 60μ in $R_a$ (1.25 μM). The final gauge stainless steel is tempered after the steel is pickled.

In the present process, the operations of cold rolling, annealing, molten salt bath dipping and pickling are conducted in a single, continuous line as shown in FIG. 1. However, it is to be distinctly understood that the present invention can be accomplished using separate lines for any or all of the discrete operations. It is to be further understood that the present process can be used to produce a final gauge product from a thin-strip caster. Such strip cast can be processed in accordance with the present invention to achieve the surface smoothness obtained by the hot rolled steel strip. Such strip cast requires the use of a single stand reducing mill.

EXAMPLE 1

A first trial of the present invention was performed in which 0.130" gauge hot bands were finished according to standard practice resulting in a roughly 1450° F. coiling temperature. All bands exhibited a symmetric 3% crown. Cold rolling was accomplished on a Four High roller press using 13" standard 220 grit (Ra=7μ) steel work rolls. Coolant concentrations varied in the mill from 3% to 6%.

The coils were reduced 58% to 0.054" nominal gauge. The black band scale pattern resulted in non-uniform roll wear 6" to 8" in from either edge of the strip. This pattern may have been aggravated by the higher coolant concentrations, which appear to cause more dirt or scale to adhere to the work rolls. Excessive roll wear was noted, and three roll changes were required.

This rolling produced final coils having a surface roughness of 30–45μ Ra in the crown and 60–100μ Ra 6" to 8" in from either edge. The nonuniform hot band scale, the high coolant concentrations and the work rolls themselves were felt to contribute to this variation.

EXAMPLE 2

A second trial was employed using the 0.130" gauge hot bands. In this second trial, the bands were laminar cooled on the final finishing stand to produce coiling temperatures in the range of 1150° F. All of these bands exhibited a 0.005" wedge from edge to edge. Cold rolling was accomplished with a combination of standard 220 grit steel rolls and 250 RA chromium plated electro-discharge-textured (EDT) work rolls. Coolant concentration was aimed at 3%.

All coils were successfully reduced 58% to 0.054" gauge with little difficulty. The first four and a half coils were rolled on a single set of EDT rolls. The balance of the coils were rolled on two sets of standard steel rolls. In all cases, uniform scale breakage was observed across the strip, primarily as a result of laminar cooling.

The final surfaces of the 250μ Ra EDT roll coils was somewhat coarse but reasonably uniform, averaging around 110μ Ra after pickling. This is rougher than the 20–30μ Ra seen typically on production stainless steel surfaces. The surfaces of the coils rolled on the 220 grit rolls were somewhat blotchy.

EXAMPLE 3

A third trial involved a variety of hot band sizes ranging in nominal gauge from 0.080" to 0.095" and 33" to 37" in width. All bands were laminar cold, and only one exhibited a slight wedge. These bands were also edge trimmed where previous rolling had been done on mill edge. Chromium plated 125μ Ra EDT rolls were used exclusively for the cold rolling. The total reduction ranged from 36% to 42%, which were accomplished in two to four passes depending on the gauge.

The final surface roughness on these trial coils was fairly uniform, and ranged from 51–78μ Ra following pickling. Little difficulty was encountered in the rolling other than the fact the actual gauges of the black bands required more passes than anticipated from the stated nominal gauges. An even fuller utilization of the second set of EDT rolls would have been possible, had more coils been available.

EXAMPLE 4

The coils from Example 1 were annealed at typical parameters of 1800° F. and 45 feet per minute. This resulted in the properties shown in Table 1. These properties would ordinarily be considered acceptable. However, microstructurally, there was a larger variation in grain size within a coil than is typically seen. These larger grains, the variation and surface roughness, and a "orange peel" surface on Oleson Cup samples rendered these samples unacceptable.

TABLE 1

| # | COIL # | % RED | NO. PASSES | END TEST-ED | TEMP | 11-LINE FPM | RA | RB | YIELD | TEN-SILE | ELONG | GRAIN # | R-BAR |
|---|---|---|---|---|---|---|---|---|---|---|---|---|---|
| 1 | W1755105 | 58% | 5 | H | 1800 | 49 | | RB 66 | 42,000 | 65,100 | 29% | RANGE 4–7 GRAIN GA | |
| | .130 GA | | | T | 1800 | 49 | | RB 65 | 41,100 | 64,400 | 30% | RANGE 4–7 GRAIN GA | |
| 2 | W175106 | 58% | 5 | H | 1800 | 49 | | RB 62 | 40,200 | 63,800 | 31% | RANGE 5–8 GRAIN GA | |
| | .130 GA | | | T | 1800 | 49 | | RB 64 | 37,900 | 61,500 | 30% | RANGE 4–7 5% HB | |
| 3 | W175107 | 58% | 4 | H | 1800 | 49 | | RB 66 | 39,200 | 62,700 | 34% | RANGE 4–7 GRAIN GA | |
| | .130 GA | Broke at .064 | | T | 1800 | 49 | | RB 65 | 40,900 | 62,700 | 27% | RANGE 4–7 GRAIN GA | |
| 4 | W175108 | 58% | 5 | H | 1800 | 49 | | RB 64 | 38,600 | 62,800 | 30% | RANGE 5–7 GRAIN GA | |
| | .130 GA | | | T | 1800 | 49 | | RB 64 | 38,400 | 62,200 | 30% | RANGE 5–8 GRAIN GA | |
| 5 | W175109 | 58% | 5 | H | 1800 | 49 | | RB 63 | 40,400 | 63,100 | 31% | RANGE 3–6 GRAIN GA | |
| | .130 GA | | | T | 1800 | 49 | | RB 64 | 40,100 | 63,100 | 30% | RANGE 3–6 GRAIN GA | |
| 6 | W175110 | 58% | 5 | H | 1800 | 49 | | RB 63 | 41,100 | 63,100 | 33% | RANGE 4–7 GRAIN GA | |
| | .130 GA | | | T | 1800 | 49 | | RB 64 | 37,400 | 61,100 | 33% | RANGE 3–7 GRAIN GA | |
| 7 | W175111A | 58% | 5 | H | 1800 | 49 | | RB 64 | 41,100 | 64,100 | 32% | RANGE 4–7 GRAIN GA | |
| | .130 GA | | | T | 1800 | 49 | | RB 65 | 41,100 | 63,000 | 33% | RANGE 4–7 GRAIN GA | |
| 8 | W175111B | 58% | 5 | H | 1800 | 45 | | RB 63 | 41,400 | 66,000 | 31% | RANGE 4–8 GRAIN GA | |
| | .130 GA | | | T | 1800 | 45 | | RB 65 | 39,400 | 62,000 | 31% | RANGE 4–7 GRAIN GA | |
| 9 | W175112 | 58% | 5 | H | 1800 | 49 | | RB 62 | 41,500 | 64,300 | 30% | RANGE 4–7 GRAIN GA | |
| | .130 GA | | | T | 1800 | 49 | | RB 62 | 42,100 | 66,000 | 28% | RANGE 4–6 GRAIN GA | |

NOTE: No RA or R-Bar testing was performed for Trial #1 Coils.

EXAMPLE 5

Because of the rougher surfaces seen on the coils from Example 2, it was decided to anneal the Example 2 coils at standard parameters of 1840° F. and 62 feet per minute. During the course of the annealing, it became apparent that these parameters were "over annealing" the coils and the line speed was increased up to 74 feet per minute. The properties achieved in these coils are shown in Table 2. Again, the properties were acceptable, but the microstructures and surfaces were not.

TABLE 2

| # | COIL # | % RED | NO. PASSES | END TEST-ED | TEMP | 11-LINE FPM | RA | RB | YIELD | TEN-SILE | ELONG | GRAIN # | R-BAR |
|---|---|---|---|---|---|---|---|---|---|---|---|---|---|
| 1 | W195589 | 58% | 6 | H | 1840 | 74 | 40 | RB 65 | 39,800 | 62,800 | 29% | RANGE 4–8 GRAIN GA | |
| | .130 GA | | 1-EDT 5–220 | T | 1840 | 74 | 51 | RB 64 | 38,600 | 60,400 | 29% | RANGE 3–8 GRAIN GA | |
| 2 | W195590 | 58% | 5–220 | H | 1840 | 62 | 43 | RB 64 | 39,100 | 61,100 | 30% | RANGE 3–8 GRAIN GA | 1.37 |
| | .130 GA | | GRIT | T | 1840 | 68 | 55 | RB 62 | 40,100 | 61,800 | 33% | RANGE 3–8 GRAIN GA | 1.25 |
| 3 | W195591 | 58% | 5-EDT | H | 1840 | 68 | 43 | RB 61 | 36,800 | 60,100 | 30% | RANGE 4–8 GRAIN GA | |
| | .130 GA | | | T | 1840 | 68 | 55 | RB 62 | 36,700 | 59,800 | 30% | RANGE 2–8 GRAIN GA | |
| 4 | W195592 | 58% | 5-EDT | H | 1840 | 68 | 99 | RB 64 | 39,200 | 61,500 | 29% | RANGE 4–7 GRAIN GA | |
| | .130 GA | | | T | 1840 | 68 | 118 | RB 63 | 41,100 | 65,400 | 30% | RANGE 4–7 GRAIN GA | |
| 5 | W195593 | 58% | 5–220 | H | 1840 | 62 | 43 | RB 62 | 39,100 | 60,900 | 29% | RANGE 5–7 | 1.22 |

TABLE 2-continued

| # | COIL # | % RED | NO. PASSES | END TEST-ED | TEMP | 11-LINE FPM | RA | RB | YIELD | TEN-SILE | ELONG | GRAIN # | R-BAR |
|---|---|---|---|---|---|---|---|---|---|---|---|---|---|
| | .130 GA | | GRIT | T | 1840 | 62 | 38 | RB 64 | 38,100 | 60,300 | 31% | GRAIN GA RANGE 3–8 | |
| 6 | W195594 | 58% | 5 | H | 1840 | 74 | 59 | RB 65 | 40,200 | 64,300 | 29% | GRAIN GA RANGE 5–8 | |
| | .130 GA | | 3-EDT | T | 1840 | 74 | 51 | RB 65 | 40,400 | 63,500 | 31% | GRAIN GA RANGE 4–8 | |
| 7 | W195595 | 58% | 2–220 5-EDT | H | 1840 | 68 | 126 | RB 62 | 39,500 | 61,800 | 30% | GRAIN GA RANGE 4–8 | 1.32 |
| | .130 GA | | | T | 1840 | 68 | 130 | RB 64 | 40,100 | 62,500 | 29% | GRAIN GA RANGE 4–8 | |
| 8 | W195596 | 58% | 5–220 | H | 1840 | 74 | 31 | RB 65 | 40,100 | 62,000 | 29% | GRAIN GA RANGE 4–7 | |
| | .130 GA | | GRIT | T | 1840 | 74 | 42 | RB 65 | 40,000 | 62,200 | 31% | GRAIN GA RANGE 4–7 | |
| 9 | W195597 | 58% | 5–220 | H | 1840 | 74 | 42 | RB 64 | 40,000 | 62,300 | 29% | GRAIN GA RANGE 4–8 | |
| | .130 GA | | GRIT | T | 1840 | 74 | 46 | RB 66 | 39,500 | 61,600 | 30% | GRAIN GA RANGE 4–8 | |
| 10 | W195604 | 58% | 5-EDT | H | 1840 | 62 | 132 | RB 62 | 39,000 | 60,200 | 30% | GRAIN GA RANGE 3–7 | |
| | .130 GA | | | T | 1840 | 62 | 116 | RB 61 | 38,200 | 66,200 | 30% | GRAIN GA RANGE 4–7 | |
| | | | | | | | | | | | | GRAIN GA | |

NOTE: All coils exhibited a wide range of grain size with very large grains at the surface.

Figure 2A:
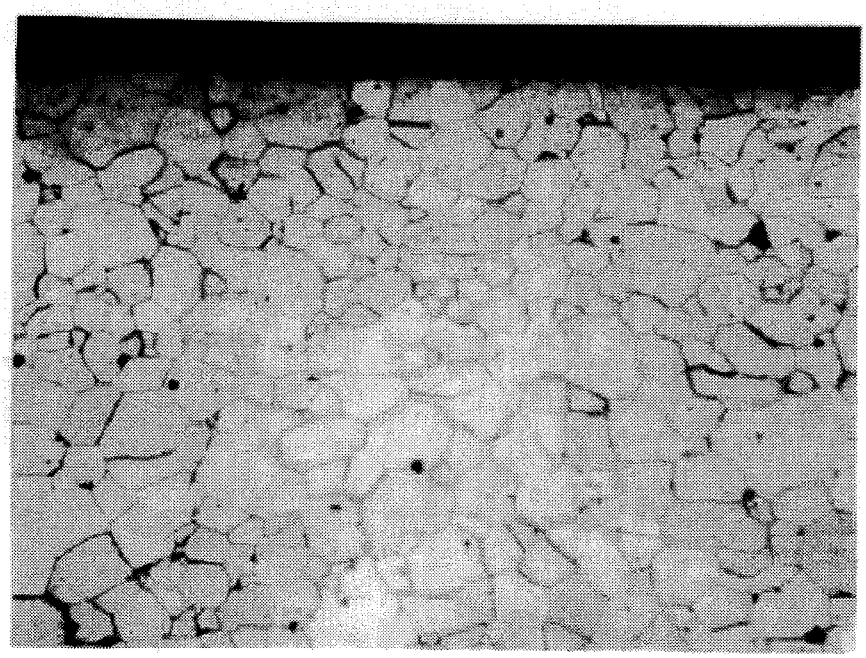
FIGS. 2*a*–2*b* are photomicrographs comparing the microstructure of the surface of a typical stainless steel and the microstructure of a stainless steel formed in accordance with the present invention.
Figure 2B:
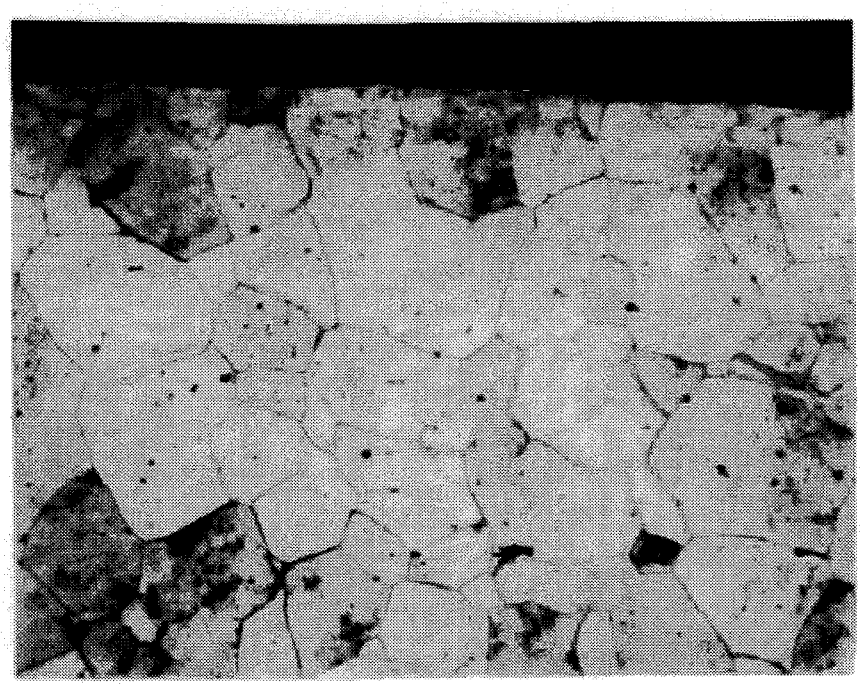

A comparison of a typical microstructure and the microstructure obtained in Example 5 using 250 μ Ra EDT rolls is shown in FIG. 2. Large grains appear on the trial coil especially toward the surface of the trial coil. This trial coil was obtained at line speeds 20% faster than normal. Based on the annealing responses seen in the second direct cold rolling trial, a series of laboratory annealing experiments were conducted. The results of these experiments are summarized in Table 3.

TABLE 3

| # | COIL # | TEMP | FURNACE TIME | 11-LINE EQUIV | RB | YIELD | TENSILE | ELONG | GRAIN # |
|---|---|---|---|---|---|---|---|---|---|
| 1 | W195591 | 1840 | 2 min | 50 FPM | RB 64 | 40200 | 60900 | 30% | RANGE 4–7 GRAIN #5 |
| 2 | W195591 | Zones 1,2 1865 2–4 1840 | Annealed on 236 1 min 28 sec | Actual Speed 68 FPM | RB 61 | 36800 | 60100 | 30% | RANGE 4–8 GRAIN #5 |
| 3 | W195591 | 1840 | 1 min 21 sec | 74 FPM | RB 65 | 39700 | 62600 | 29% | RANGE 5–8 GRAIN #6 |
| 4 | W195591 | 1840 | 1 min 9 sec | 87 FPM | RB 66 | 39200 | 61200 | 30% | RANGE 5–8 GRAIN #6 |
| 5 | W195591 | 1820 | 1 min 9 sec | 87 FPM | RB 68 | 39100 | 61500 | 29% | RANGE 5–8 GRAIN #6 |
| 6 | W195591 | 1800 | 1 min 9 sec | 87 FPM | RB 69 | 40300 | 62900 | 29% | RANGE 5–8 GRAIN #7 |
| 7 | W195591 | 1780 | 1 min 9 sec | 87 FPM | RB 69 | 40500 | 64700 | 32% | RANGE 6–8 GRAIN #7 |
| 8 | W195591 | 1840 | 1 min 3 sec | 95 FPM | RB 65 | 39600 | 63200 | 29% | RANGE 5–8 GRAIN #6 |
| 9 | W195591 | 1840 | 1 min | 100 FPM | RB 67 | 40200 | 62500 | 29% | RANGE 5–8 GRAIN #7 |
| 10 | W195591 | 1840 | 50 sec | 120 FPM | RB 69 | 43100 | 66400 | 30% | RANGE 6–8 GRAIN #7 |

EXAMPLE 6

Prior to any production annealing of coils from Example 3, a series of laboratory experiments were conducted. A summary of the data from these experiments is presented in Table 4.

TABLE 4

| # | COIL # | TEMP | FURNACE TIME | 11-LINE EQUIV | RB | YIELD | TENSILE | ELONG | GRAIN # | GA/HG |
|---|---|---|---|---|---|---|---|---|---|---|
| 1 | W218074 | 1840 | 1 min 21 sec | 74 FPM | RB 67 | 39700 | 62300 | 32% | RANGE 5–8 GRAIN 6 | GA |
| 2 | W218074 | 1840 | 1 min 9 sec | 87 FPR | RB 67 | 40300 | 63100 | 27% | RANGE 5–8 GRAIN 6 | HB |
| 3 | W218074 | 1840 | 1 min | 100 FPM | RB 67 | 40600 | 64400 | 32% | RANGE 5–8 GRAIN 6 | GA |
| 4 | W218074 | 1820 | 1 min 9 sec | 87 FPM | B 68. | 40700 | 64000 | 32% | RANGE 5–8 GRAIN #7 | HB |
| 5 | W218014 | 1800 | 1 min 9 sec | 87 FPM | RB 68 | 41300 | 65500 | 28% | RANGE 6–8 GRAIN 7 | HB |
| 6 | W218074 | 1780 | 1 min 9 sec | 87 FPM | RB 67 | 41100 | 64600 | 30% | RANGE 6–8 GRAIN 7 | GA |
| 1 | W218078 | 1840 | 1 min 21 sec | 74 FPM | RB 65 | 40500 | 62300 | 34% | RANGE 4–8 GRAIN 5 | GA |
| 2 | W218078 | 1840 | 1 min 9 sec | 87 FPM | RB 66 | 40000 | 63300 | 32% | RANGE 5–8 GRAIN 6 | HB |
| 3 | W218078 | 1840 | 1 min | 100 FPM | RB 68 | 41900 | 65000 | 35% | RANGE 5–8 GRAIN 6 | HB |
| 4 | W218078 | 1820 | 1 min 9 sec | 87 FPM | RB 67 | 41600 | 64400 | 31% | RANGE 5–8 GRAIN 6 | HB |
| 5 | W218078 | 1800 | 1 min 9 sec | 87 FPM | RB 67 | 40700 | 64200 | 31% | RANGE 5–8 GRAIN 6 | HB |
| 6 | W218078 | 1780 | 1 min 9 sec | 87 FPM | B 65. | 41500 | 64600 | 30% | RANGE 5–8 GRAIN 7 | HB |
| 1 | W218110 | 1840 | 1 min 21 sec | 74 FPM | B 67. | 41900 | 64200 | 28% | RANGE 4–7 GRAIN 5 | GA |
| 2 | W218110 | 1840 | 1 min 9 sec | 87 FPM | RB 67 | 40300 | 64900 | 30% | RANGE 4–7 GRAIN 5 | GA |
| 3 | W218110 | 1840 | 1 min | 100 FPM | B 66. | 42600 | 66400 | 32% | RANGE 5–8 GRAIN 6 | GA |
| 4 | W218110 | 1820 | 1 min 9 sec | 87 FPM | RB 67 | 42400 | 64400 | 32% | RANGE 5–8 GRAIN 6 | GA |
| 5 | W218111 | 1800 | 1 min 9 sec | 87 FPM | RB 66 | 42500 | 66500 | 33% | RANGE 5–8 GRAIN 6 | GA |
| 6 | W218110 | 1780 | 1 min 9 sec | 87 FPM | RB 67 | 43000 | 66800 | 29% | RANGE 5–8 GRAIN 7 | GA |
| 1 | W218111 | 1840 | 1 min 21 sec | 74 FPM | RB 67 | 42000 | 63400 | 29% | RANGE 4–7 GRAIN 5 | GA |
| 2 | W218111 | 1840 | 1 min 9 sec | 87 FPM | RB 68 | 41100 | 64900 | 28% | RANGE 4–8 GRAIN 5 | GA |
| 3 | W218111 | 1840 | 1 min | 100 FPM | RB 66 | 43400 | 66300 | 23% | RANGE 5–8 GRAIN 6 | GA |
| 4 | W218111 | 1820 | 1 min 9 sec | 87 FPM | RB 67 | 43200 | 65700 | 27% | RANGE 5–7 GRAIN 6 | GA |
| 5 | W218111 | 1800 | 1 min 9 sec | 87 FPM | RB 68 | 42500 | 65900 | 29% | RANGE 6–8 GRAIN 6 | GA |
| 6 | W218111 | 1780 | 1 min 9 sec | 87 FPM | RB 65 | 43900 | 67200 | 28% | RANGE 6–8 GRAIN 6 | GA |

The results of the experiments for the 125μ Ra EDT rolls of Example 3 were similar to those seen in the experiments conducted on the 250μ Ra EDT rolls of Example 2. Proper annealing could be obtained at parameters of 1840° F. and 100 feet per minute. However, due to pickling considerations, it was decided to limit the line speed to 87 feet per minute and reduce the temperature to 1800° F.

Another consideration for the direct cold rolling trial in Example 3 was to assess what impact, if any, lower amounts of cold reduction would have on the final annealed microstructures. Production 0.054" gauge J&L grade 409 steel typically receives a 60% cold reduction. Such a large reduction is believed necessary to fully cold work the core to insure a uniform recrystallized and annealed cold worked structure rather than an over-annealed, coarse grained, hot worked structure at the core.

Figure 3A:
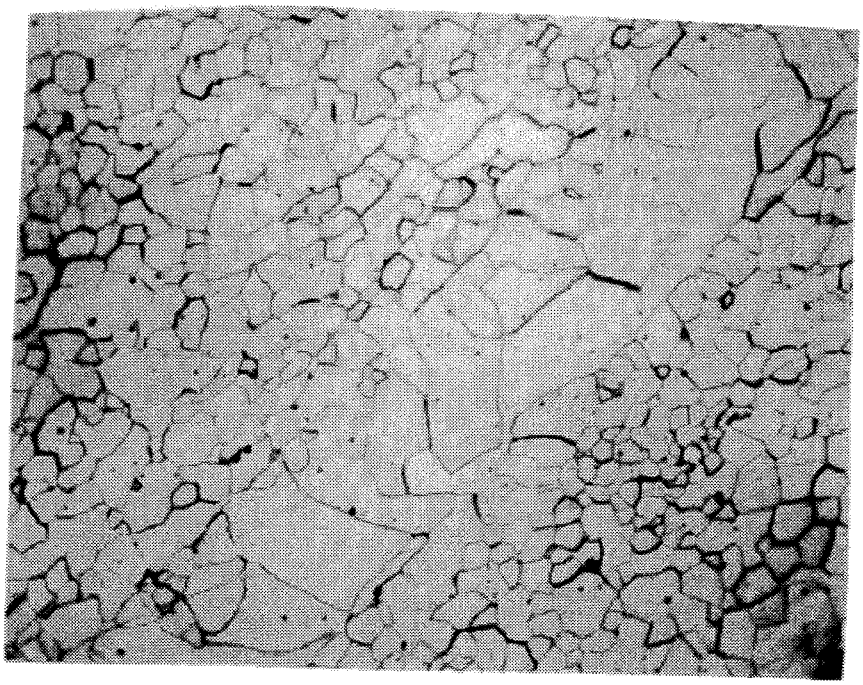
FIGS. 3*a*–3*b* are photomicrographs comparing the surface of a stainless steel formed in accordance with the present invention showing evidence of residual hot band in the core and the surface of a stainless steel formed in accordance with the present invention showing no evidence of residual hot band in the core.
Figure 3B:
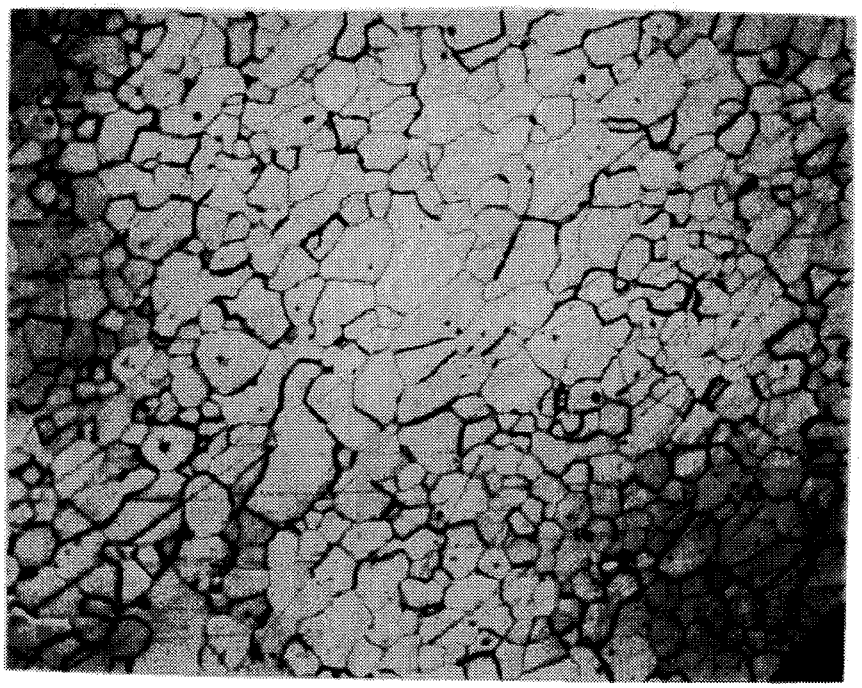

Three out of the six samples tested showed evidence of a coarse residual "hot band" structure in the annealing experiments. FIG. 3 shows a pair of photomicrographs from samples with and without the "hot band" structure.

Figure 4A:
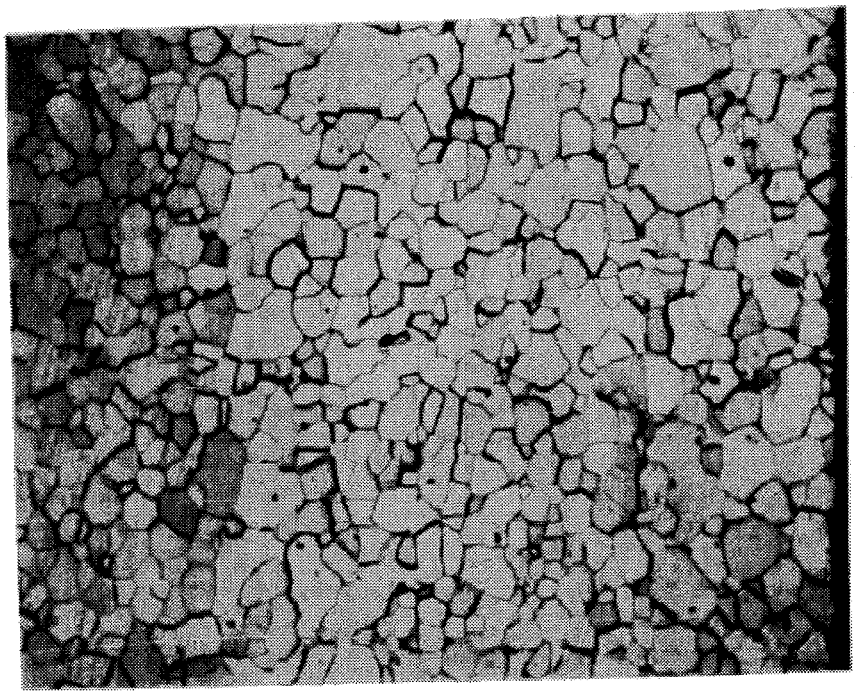
FIGS. 4*a*–4*b* are photomicrographs showing the microstructure of the surface of the head of a coil and the tail of the same coil formed under different parameters in accordance with the present invention.
Figure 4B:
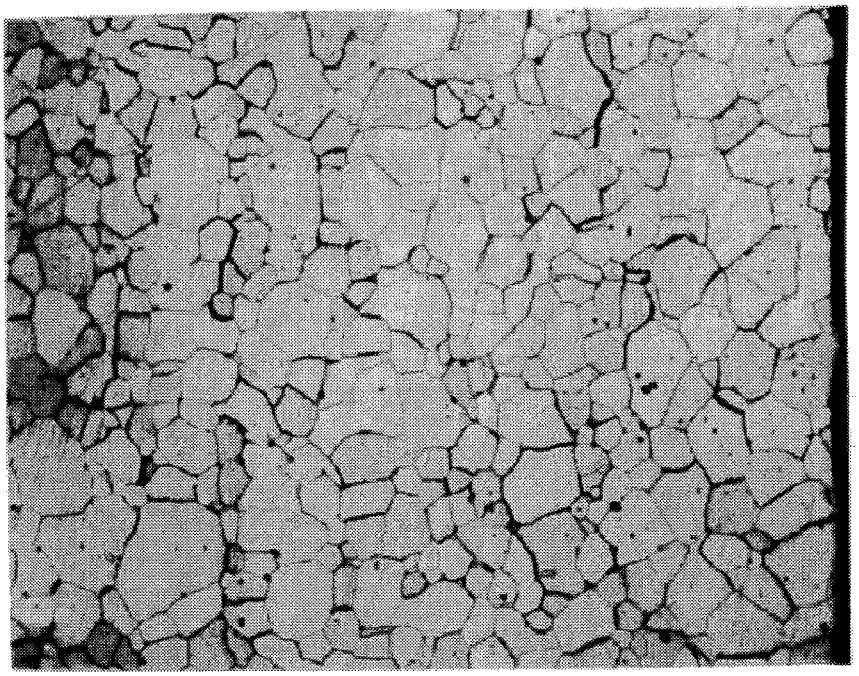

Coil W218110 was the first coil from Example 3 to be annealed in production. The head of this coil was annealed at 1800° F. and 87 feet per minute by decreasing the speed and temperature at the tail of the coil proceeding it. In an attempt to improve the pickling of this coil, the speed was later reduced to 62 feet per minute and the temperature correspondingly dropped to 1775° F. Photomicrographs of the head and tail of this coil are shown in FIG. 4. Both would be considered acceptable in production.

Figure 5A:
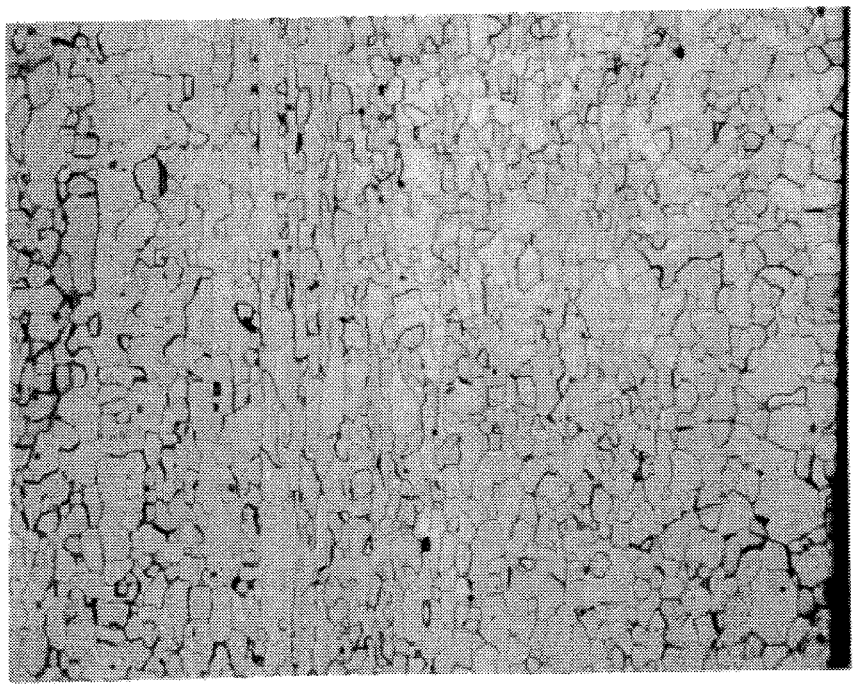
FIGS. 5*a*–5*b* are photomicrographs showing the microstructure of the surface of the head of a coil and the tail of the same coil formed under different parameters in accordance with the present invention.
Figure 5B:
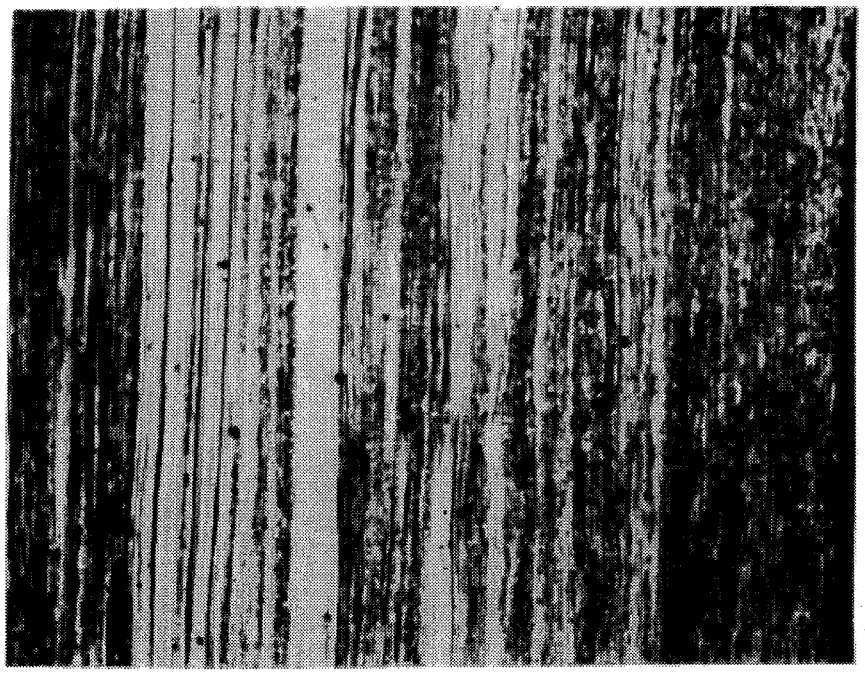

FIG. 5 shows photomicrographs of coil W184949 which was a production coil annealed just prior to the direct cold rolled coil. The lower photomicrograph of FIG. 6 shows the residual cold work in the tail which resulted when the temperature was decreased and speed increased prior to the head of the direct cold rolled coil. The effects of the faster annealing rate of 125μ Ra EDT direct cold rolled coils can be seen by comparing the upper photomicrograph of FIG. 4 to the lower photograph of FIG. 5. These photomicrographs were taken from adjoining head and tail sections and were both annealed at the same parameters.

The remaining coils from Example 3 were annealed at speeds ranging from 100 feet to 72 feet per minute and temperatures from 1775° F. to 1800° F. These variations were primarily made to explore pickling issues. The resulting properties and microstructures are presented in Table 5.

TABLE 5

| # | COIL # | % RED | NO. PASSES | END TEST-ED | TEMP | 11-LINE FPM | RA | RB | YIELD | TEN-SILE | ELONG | GRAIN # | R-BAR |
|---|---|---|---|---|---|---|---|---|---|---|---|---|---|
| 1 | W218074 | 43% | 4 | H | 1775 | 72 | 52 | RB 66 | 39,300 | 64,000 | 30% | RANGE 6–7 10% HB | 1.24 |
| | .095 GA | | | T | 1780 | 80 | 51 | RB 66 | 39,000 | 62,700 | 30% | RANGE 5–6 10% HB | 1.12 |
| 2 | W218075 | 43% | 4 | H | 1775 | 72 | No test taken at 11-line | | | | | | |
| | .095 GA | | | T | 1775 | 72 | 78 | RB 65 | 41,400 | 65,000 | 30% | RANGE 6–7 5% HB | 1.42 |
| 3 | W218076 | 43% | 4 | H | 1800 | 87 | 54 | RB 66 | 39,700 | 63,500 | 31% | RANGE 6–7 GRAIN GA | 1.40 |
| | .095 GA | | | T | 1775 | 72 | 75 | RB 67 | 40,700 | 64,500 | 30% | RANGE 6–7 5% HB | 1.27 |
| 4 | W218077 | 40% | 4 | H | 1800 | 87 | 56 | RB 65 | 40,400 | 64,100 | 31% | RANGE 6–7 5% HB | 1.14 |
| | .090 GA | | | T | 1800 | 87 | 61 | RB 66 | 41,500 | 65,200 | 30% | RANGE 6–7 GRAIN GA | |
| 5 | W218078 | 40% | 3 | H | 1800 | 87 | 68 | RB 66 | 40,000 | 64,000 | 31% | RANGE 6–7 GRAIN GA | 1.27 |
| | .090 GA | | | T | 1800 | 100 | 48 | RB 65 | 40,200 | 64,700 | 30% | RANGE 6–7 GRAIN GA | 1.17 |
| 6 | W218108 | 43% | 4 | H | 1780 | 80 | 57 | RB 67 | 39,700 | 6,340 | 31% | RANGE 6–7 GRAIN GA | |
| | .095 GA | | | T | 1800 | 87 | 58 | RB 67 | 40,500 | 64,000 | 30% | RANGE 5–6 5% HB | |
| 7 | W218109 | 43% | 4 | H | 1800 | 87 | 67 | RB 65 | 40,700 | 64,500 | 31% | RANGE 6–7 5% HB* | |
| | .095 GA | | | T | 1800 | 87 | 68 | RB 65 | 39,600 | 62,900 | 31% | RANGE 5–6 GRAIN GA | |
| 8 | W218110 | 43% | 4 | H | 1800 | 87 | 61 | RB 67 | 39,900 | 62,500 | 32% | RANGE 5–8 GRAIN GA | 1.24 |
| | .095 GA | | | T | 1775 | 62 | 76 | RB 67 | 40,700 | 63,600 | 31% | RANGE 5–6 GRAIN GA | 1.36 |
| 9 | W218111 | 33% | 2 | H | 1800 | 87 | 72 | RB 66 | 42,200 | 63,900 | 30% | RANGE 5–6 GRAIN GA | 1.21 |
| | .080 GA | | | T | 1780 | 80 | 76 | RB 67 | 39,800 | 64,800 | 31% | RANGE 5–6 5% HB | 1.13 |
| 10 | W218112 | 33% | 2 | H | 1800 | 100 | 61 | RB 67 | 40,700 | 64,700 | 30% | RANGE 5–6 10% HB | 1.12 |
| | .090 GA | | | T | 1800 | 87 | 59 | RB 63 | 41,200 | 64,000 | 31% | RANGE 6–7 GRAIN GA | 1.25 |

*NOTE: Coil cropped back 50 ft. on slitter. Retest micro - GA

EXAMPLE 7

The annealed strips from Example 4 were pickled using standard pickle tank configurations. In these configurations, three tanks are used. The first tank is set up with 20% sulfuric acid. The second tank contains 7% nitric acid and 1.5% hydrofluoric acid. The third tank contains 7% nitric acid and 0.25% hydrofluoric acid. The strip is only submerged in the first and third tanks. Dipping the stainless steel into the high nitric/hydrofluoric concentration in the second tank quickly builds up heat and eventually results in $NO_x$ emissions.

The coils from the annealing section of Example 4 were found to contain small amounts of embedded scale when only the first and third pickle tanks were used. In order to remove the embedded scale, it was necessary to partially submerge the strip in the second tank. The bulk of the coils were processed in this manner, while the $NO_x$ emissions were carefully monitored.

EXAMPLE 8

The annealed strips from Example 5 were pickled using the standard pickle tank configurations set forth above. The coils which were directly cold rolled with 250 μ Ra EDT rolls were successfully pickled at speeds up to 75 feet per minute with only two tanks being used. However, for the coils rolled on 220 grit steel rolls, it was again necessary to employ all three tanks in order to clean up the steel.

EXAMPLE 9

The annealed coils from Example 6 were pickled using the standard pickle tank configurations set forth above. The work roll roughness decreased to 125μ Ra for these rolls did have an impact on pickling. Line speeds were decreased from 87 feet per minute to 62 feet per minute on the first coil in an attempt to use only two pickling tanks. This was not successful and resulted in some embedded scale and a band of loose scale which was readily removed by dipping the strip in the second tank. Increasing the scrubber brush pressure to facilitate removal of the loose scale helped, but did not remove the embedded scale. As a consequence, the majority of these coils were pickled using all three tanks.

Coils rolled on the first set of 125μ Ra EDT rolls did not pickle as well as those pickled on the second set. For example, all the coils rolled on the second set of rolls were successfully pickled at 87 feet per minute using three tanks. By contrast, those from the first set were slowed down to 72 feet per minute and three coils exhibited embedded scale which was removed in a subsequent repickling operation.

In the foregoing specification certain preferred practices and embodiments of this invention have been set out, however, it will be understood that the invention may be otherwise embodied within the scope of the following claims.

I claim:

1. A process line for converting unrecrystallized hot band stainless steel strip to a final gauge product without an annealing section positioned before a rolling mill, said process line comprising the following stations positioned in the sequential order of a rolling mill to reduce the thickness of said unrecrystallized hot band stainless steel to a final gauge thickness and to crack the scale on the surface of said hot band stainless steel strip, an annealing section positioned after said rolling mill to anneal said final gauge thickness strip from said rolling mill, and a pickling section to pickle said annealed strip from said annealing section and remove the scale from said surface of said final gauge thickness strip.

2. The process of claim 1 further comprising a molten salt bath section provided intermediate said annealing section and said pickling section to condition the scale cracked in said rolling mill and pass said stainless steel to said pickling section.

3. The process line of claim 2 wherein said molten salt is a kolene type salt.

4. The process line of claim 2 further comprising a temper-pass section to temper-pass the final gauge stainless steel exiting the pickling section.

5. The process line of claim 1 wherein said stainless steel strip is hot rolled stainless steel strip.

6. The process line of claim 1 wherein said stainless steel strip is thin-strip cast.

7. The process line of claim 1 wherein said process line further comprises eliminating the pickling section before the rolling mill.

8. The process line of claim 7 wherein said process line is a continuous process line.

9. The process line of claim 1 wherein said stainless steel strip is J&L 409 grade steel.

10. The process line of claim 1 wherein said final gauge product has a surface roughness no greater than 35μ Ra in an untemper-passed condition.

11. A method for converting unrecrystallized hot band stainless steel strip to a final gauge product including, with neither an annealing step nor a pickling step before a step of cold rolling said hot band stainless steel strip, said method consisting essentially the following steps in the sequential order of cold rolling said unrecrystallized hot band strip to reduce the thickness of said unrecrystallized hot band stainless steel to a final gauge thickness and to crack the scale on the surface of said hot band stainless steel strip, annealing said final gauge thickness strip, and pickling said annealed strip to remove the scale from said surface of said final gauge thickness strip.

12. The method of claim 11 further comprising the intermediate step of conditioning the scale on said surface of said annealed strip in a molten salt bath before said annealed strip is pickled.

13. The method of claim 11 wherein said molten salt is a kolene type salt.

14. The method of claim 11 further comprising the step of temper-passing the final gauge stainless steel after pickling.

15. The method of claim 11 wherein said stainless steel strip is hot rolled strip.

16. The method of claim 11 wherein said stainless steel strip is thin-cast strip.

17. The method of claim 11 wherein said unrecrystallized hot band stainless steel strip is converted to a final gauge product in one continuous process line.

18. The method of claim 11 wherein said stainless steel strip is J&L 409 grade steel.

19. The method of claim 11 wherein said final gauge product has a surface roughness no greater than 35μ Ra in an in untemper-passed condition.

20. A process for converting unrecrystallized stainless steel strip to a final gauge product, with neither an annealing step nor a pickling step before a step of cold rolling said hot band stainless steel strip, said process consisting essentially the following steps in the sequential order of cold rolling said unrecrystallized hot band strip in a rolling mill to reduce the thickness of said unrecrystallized stainless steel to a final gauge thickness and to crack the scale on the surface of said hot band stainless steel strip, annealing said final gauge thickness strip from said rolling mill, conditioning the scale on said surface of said annealed strip in a molten salt bath, and pickling said annealed strip from said annealing section to remove the scale from said surface of said final gauge thickness strip.

21. The process of claim 20 wherein said stainless steel strip is hot rolled strip.

22. The process of claim 20 wherein said stainless steel strip is thin-cast strip.

23. The process of claim 20 wherein said unrecrystallized hot band stainless steel strip is converted to a final gauge product in one continuous process line.

24. The process of claim 20 wherein said stainless steel strip is J&L 409 grade steel.

25. The process of claim 20 wherein said final gauge product has a surface roughness no greater then 35μ Ra in an untemper-passed condition.

* * * * *

UNITED STATES PATENT AND TRADEMARK OFFICE

CERTIFICATE OF CORRECTION

PATENT NO. : 5,606,787
DATED : March 4, 1997
INVENTOR(S) : MICHAEL F. MCGUIRE

It is certified that error appears in the above-indentified patent and that said Letters Patent is hereby corrected as shown below:

Column 6, Table 1, under the heading "Grain #", line 11, change "Range 4-7" to --Range 3-7--.

Column 6, Table 1, under the heading "Grain #", line 12, change "Range 3-7" to --Range 4-7--.

Column 9, Table 4, under the heading "11-Line Equiv", line 2, change "87 FPR" to --87 FPM--.

Column 9, Table 4, under the heading "Coil #", line 17, change W218111" to --W218110--.

Column 12, Table 5, under the heading "Grain #", line 14, change "Range 5-6" to --Range 6-7--.

Column 12, Table 5, under the heading "Grain #", line 16, change "Range 5-6" to --Range 4-8--.

Column 13, claim 11, line 45, delete "including".

Signed and Sealed this

Tenth Day of June, 1997

*Attest:*

*Attesting Officer*

Bruce Lehman

BRUCE LEHMAN

*Commissioner of Patents and Trademarks*